US006557862B1

(12) United States Patent
Gallo

(10) Patent No.: US 6,557,862 B1
(45) Date of Patent: May 6, 2003

(54) SKATES TO ROLL ON THE ROAD OR SLIDING ON THE ICE

(76) Inventor: Pellegrino Gallo, Via Eleonora Duse 3, Rome (IT)

( * ) Notice: Subject to any disclaimer, the term of this patent is extended or adjusted under 35 U.S.C. 154(b) by 0 days.

(21) Appl. No.: 09/330,334

(22) Filed: Jun. 11, 1999

(30) Foreign Application Priority Data

Jun. 15, 1998 (IT) ..... RM98A0393

(51) Int. Cl.[7] ..... A63C 17/02; A63G 17/04

(52) U.S. Cl. ..... 280/11.204; 280/11.232; 280/11.27

(58) Field of Search ..... 280/7.13, 841, 280/11.19, 11.204, 11.221, 11.223, 11.231, 11.232, 11.27, 11.3, 11.201

(56) References Cited

U.S. PATENT DOCUMENTS 1,702,316 A * 2/1929 Ridgers ..... 280/11.14
1,989,344 A * 1/1935 Tracey ..... 280/11.26
3,734,244 A * 5/1973 Roddy ..... 188/83
4,932,676 A * 6/1990 Klamer ..... 280/11.2
5,184,834 A * 2/1993 Yu ..... 280/7.13
5,253,884 A * 10/1993 Landers ..... 280/11.27
5,421,596 A * 6/1995 Lee ..... 280/11.19
5,505,470 A * 4/1996 Hoshizaki ..... 280/11.22
5,634,648 A * 6/1997 Tonel et al. ..... 280/11.22
5,797,608 A * 8/1998 Haldemann ..... 280/11.3
5,810,369 A * 9/1998 Wilder et al. ..... 280/11.22
5,873,583 A * 2/1999 Moore ..... 280/11.21
5,904,359 A * 5/1999 Caeran et al. ..... 280/11.15
5,954,348 A * 9/1999 Santarsiero et al. ..... 280/11.21
5,957,470 A * 9/1999 Powell ..... 280/11.22
6,068,268 A * 5/2000 Cornelius et al. ..... 280/11.22
6,170,837 B1 * 1/2001 Ross ..... 280/1

* cited by examiner

*Primary Examiner*—Brian L. Johnson
*Assistant Examiner*—B. Avery
(74) *Attorney, Agent, or Firm*—Reising, Ethington, Barnes, Kisselle, Learman & McCulloch, P.C.

(57) ABSTRACT

Four wheel in-line skate, having a half-boot type inner footwear portion and an outer rigid portion made up of a first tip front portion and a second rear portion surrounding ankle and heel. Within the first and second portions are housed the inner footwear portion. The first front portion and the second rear portion of the skate are fixedly coupled each other by a flexible coupling of the lamina or spring kind, provided in correspondence of the underlying portion of the same in such a way to allow their movement and the automatic return to an alignment position. The front and rear portions are provided with vertical elements, perpendicularly provided with respect to the plane of the skate, provided at least partially one within the other, and within each one of couples of vertical elements wheels are provided, connected with the same by pins. The respective and characteristic position of the wheels combined with the rotating motion of the front and rear portions are such as to allow a thrust in line with the direction of movement of the skate offering to the skater a new and more favorable technique of skating.

7 Claims, 12 Drawing Sheets

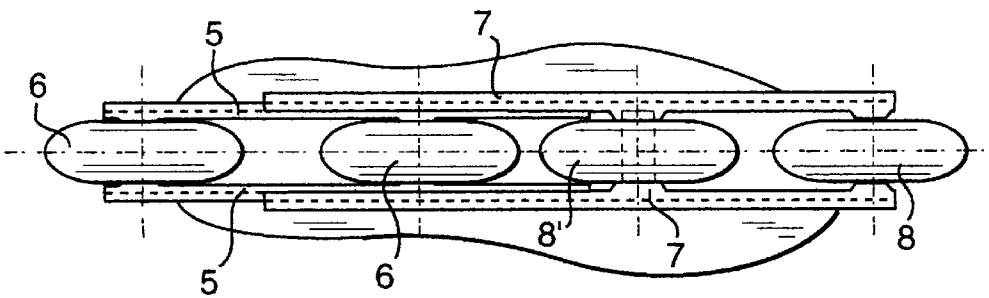
FIG. 5
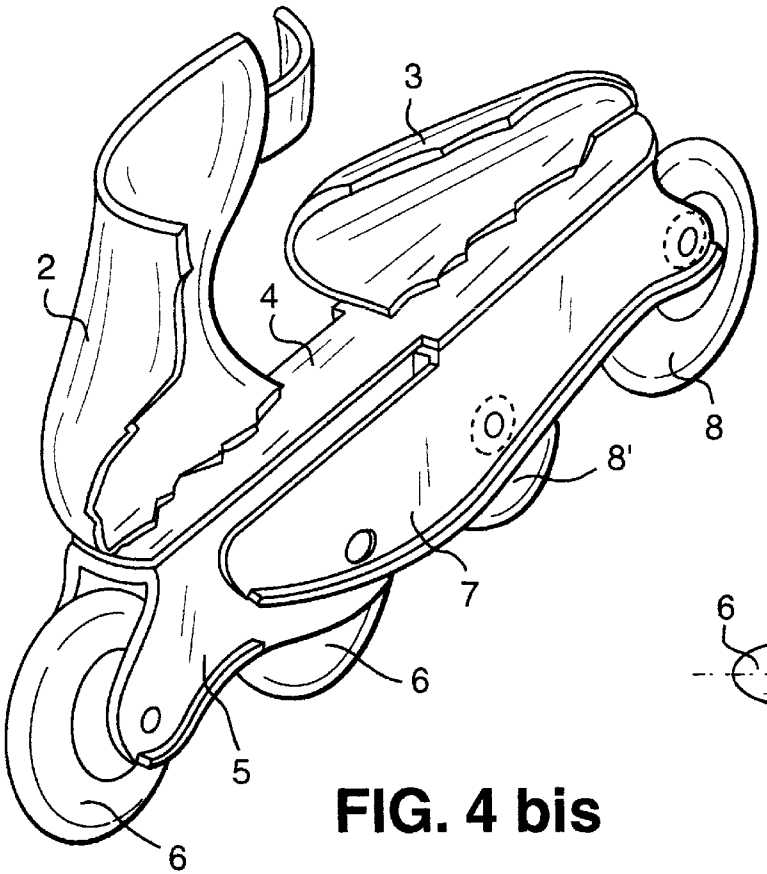
FIG. 4 bis

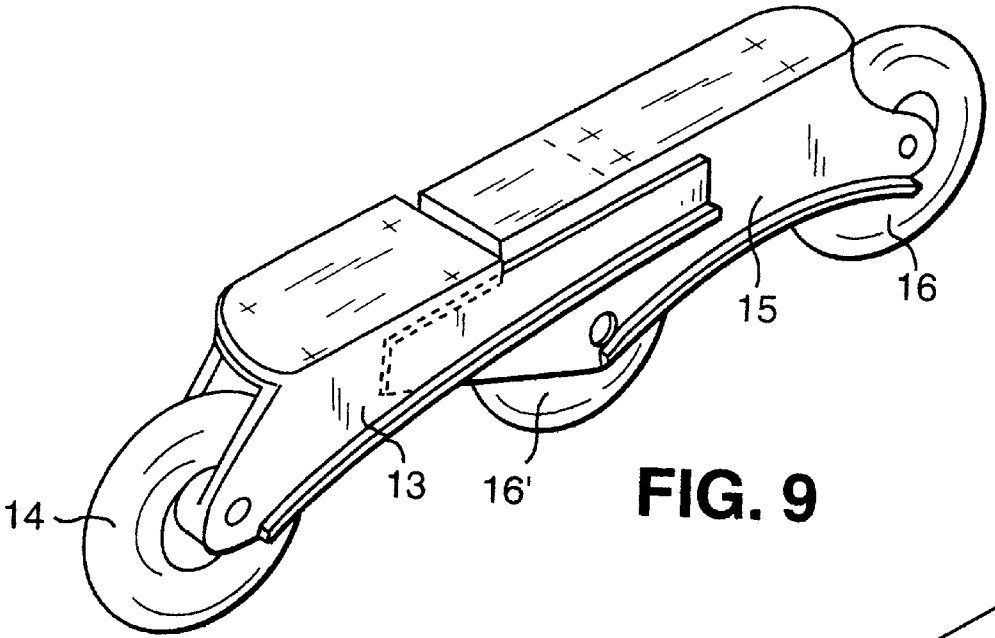
FIG. 9
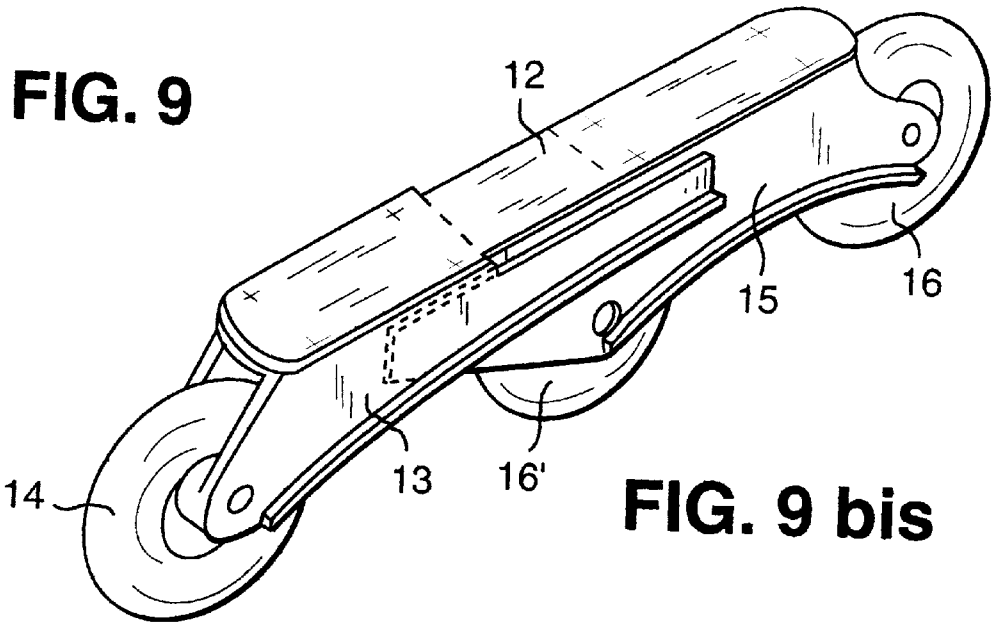
FIG. 9 bis

SKATES TO ROLL ON THE ROAD OR SLIDING ON THE ICE

FIELD OF THE INVENTION

The present invention relates to a new kind of skates to roll on the road or sliding on the ice. More particularly, it concerns a kind of skates able to offer, beyond the traditional one, a new way of skating, which is better and more complete than the previous one.

BACKGROUND OF THE INVENTION

Making reference to the roller-skating, known systems are essentially of two kinds, namely the roller skate provided with two pairs of wheels, and the most recent inline roller-skate. Both the first one and the second one require, to obtain the advancement of the skater, a thrust movement by the legs which is diagonally outward directed, during said movement the foot sole remains parallel to the ground and the body balancing is helped by a synchronized motion of the arms, which are maintained in an almost extended position.

The above motive attitude is mainly made compulsory in view of the need of grasping the ground by friction, with a transverse thrust component on the wheels, and in view of the fact that the standard skate structure is comprised of an enbloc element requiring that the foot sole subjected to a stress, remains parallel to the ground, with the wheels in contact with the same.

These two requirements, which are common for all the known skates, impose the above characteristic movement of arms and legs, and during the running and acceleration phases, the stressed prone position of the body.

It is well evident that said movement on one side and the position of the body to obtain the same movement on the other side require remarkable physical force and remarkable balance, thus limiting the practice of this sport to a limited number of persons provided with these requisites.

It is therefore well clear the need to realize a new skating system that could be much more largely diffused, also among less skilled skaters or persons having a higher position rigidity and that could constitute a valid alternative, also as urban transportation system.

SUMMARY OF THE INVENTION

This needing is satisfied according to the present invention starting from the principle of better favoring the natural movement of limbs during deambulation, thus reducing the stress necessary to obtain the motion, and particularly making it possible to vary the diagonal motion of the legs into a movement according to the motion line direction in such a way to produce the correction of the trajectory from a zigzag trajectory into a substantially rectilinear trajectory, to improve the body position, making it much more erected and thus closer to the walking and running natural position, further obtaining the advantage of increasing the advancement speed and to be able to proceed also in much more crowded places, being the space required to proceed on narrower.

To realize said needing, it is advantageously provided according to the invention to realize a roller skate having centrally aligned wheels, or paired wheels, said roller-skate allowing to the foot to fold according to the natural walking about movement, and to provide the skate with an automatic locking system, coming in contact with the ground and being operative only when the foot folds during the thrusting action, in such a way that when the foot remains flat, said locking system is inactive and the skate behaving as a traditional skate, thus being possible the traditional skating technique, and to provide the same skate with stiffening elements allowing its lateral rigidity also between the foot resting portion and the ankle, to protect the same ankle.

It is therefore specific object of the present invention a three or four wheels skate, preferably an in-line skate, characterized in that it is comprised of a half-boot type inner footwear portion and of an outer rigid portion made up of a first tip front portion and of a second rear portion surrounding ankle and heel, within said first and second portions being housed said inner footwear portion; wherein said first front portion and said second rear portion of the skate are fixedly coupled each other by flexible coupling means of the lamina or spring kind, or by other means able to carry out the same functions, provided in correspondence of the underlying portion of the same in such a way to allow their movement and the automatic return to an alignment position; wherein said front and rear portions are provided with couples of vertical elements, perpendicularly provided with respect to said flexible coupling means, provided one within the others, and within each one of said couples of vertical elements wheel means are provided, connected with the same by pin means.

Advantageously, according to the invention, said half-boot inner footwear portion, said front and rear portions coupled by the flexible element, as well as said portions perpendicular with respect to said first and second portions constitute a sole flexible, elastic and loose element, allowing to the foot to fold forward and to the skate to follow its movement, articulating to automatically assume again its attitude as soon as the foot, that has executed the thrust, detaches from the ground.

Furthermore, in view of the particular configuration of the perpendicular elements starting from said front element and from said rear element, they have elongated portions projecting forward and backward, respectively, and rotating one with respect to the other one, maintaining the contact, and remaining cinematically associated even when the foot is folded during the thrust phase on the two front wheels, and the rear wheels detach from the ground.

In this way, the necessary cinematic rigidity of the two elements along the vertical plane is guaranteed and the integrity of the ankle is saved.

Always according to the invention, it is advantageously provided to fix the most inner wheel of the front element lifted with respect to the other three wheels, in such a way that when the skate is flat (and the foot is not folded), three wheels only are in contact with the ground, thus guaranteeing the perfect stability of the same skate.

Further, according to the invention, it is provided to realize the lamina plane slightly parallel with respect to the horizontal plane, in such a way that the same is parallel with respect to the ground when the foot folds.

Further, according to the invention, said lifted inner wheel provided in the front element is of the so called "free wheel" kind, and thus realized in such a way to rotate only according to a direction, namely in an anticlockwise direction in such a way to allow the thrusting action when, subjected to the foot weight, comes in contact with the ground.

Always according to the invention, it is advantageously provided to realize a skate of the above kind provided with three wheels.

In this embodiment, the wheels are always all in contact with the ground and, taking into consideration the fact that the central wheel is a "free-wheel", the skate cannot rotate in a reverse direction, both when the foot is folded during the thrust and when the foot is flat, resting on all the wheels.

It is therefore specific object of this second embodiment a skate, characterized in that it is comprised of a half-boot type inner footwear portion and of an outer rigid portion made up of a first tip front portion and of a second rear portion surrounding ankle and heel, within said first and second portions being housed said inner footwear portion; wherein said first front portion and said second rear portion of the skate are fixedly coupled each other by flexible coupling means of the lamina or spring kind, provided in correspondence of the underlying portion of the same in such a way to allow their flexional movement; wherein said front and rear portions are provided with vertical elements, perpendicularly provided with respect to said flexible coupling means, wherein said vertical elements are provided with prolongation elements engaged each other, within said front vertical means a first and a second aligned wheels are provided, and wherein within said rear vertical means a third wheel is provided at the end.

Always according to the invention, said first, second and third wheel are fixed to said rear and front vertical elements at the same height in such a way to be in contact with the ground also when the foot is not folded during the thrust.

Further, also in this embodiment providing three aligned wheels, said central wheel is of the "free-wheel" kind, thus avoiding the reverse motion of the skate.

Always according to the invention, said front and rear vertical elements can be provided with intradorsal turn-up or ribs or cambers to ensure the required stability and rigidity.

A further embodiment of the present invention concerns a use of the same as ice skate and is characterized in that it employs the same advancement system in the same direction of the obtained motion, thus allowing to the foot to fold during the thrust phase and to the skate to grasp the ice without sliding backward.

It is therefore specific object of the present invention a further embodiment of an ice skate, characterized in that it comprises a half-boot type inner footwear portion and of an outer rigid portion made up of a first tip front portion and of a second rear portion surrounding ankle and heel, within said first and second portions being housed said inner footwear portion; wherein said front portion and said rear portion are fixedly coupled each other by flexible coupling means in such a way to allow their flexional movement and the complete folding of the foot; wherein said front and rear portions are provided with vertical elements, within which the front portion of the sliding blade is housed, wherein said sliding blade is associated with said front vertical elements by pin means; wherein said blade is contained within rear vertical means, wherein coil spring means are associated with said pin element to maintain said blade in contact with the rear portion also when the skate is not in contact with the ice; and wherein locking means of the tooth kind are provided to allow the locking of the skate on the ice during the thrust.

Always according to the invention, said tooth kind locking means are provided within the inner portion of each of said vertical elements of the front portion in such a way to surmount like a bridge said blade element.

Further, always according to the invention, said locking elements of the tooth kind are fixed to said vertical elements in such a position to avoid that they engage the ice when the skate is moving along a plane, but only when the foot is folded during the thrust.

In fact, in this situation, the rear portion lifts and the front portion rotates backwardly with respect to said coupling pin means until said tooth locking means come in contact with the ice preventing that the skate slides backward and incising the ice only as necessary and programmed since the tooth, beyond an established lowering value meets the bearing blade with its lower portion and does not further advance.

According to an advantageous solution provided in the invention, said tooth kind locking element is prevented to rotate forward by the presence of the vertical elements of the front portion against which it abuts, and is maintained in the position by elastic means preventing noxious vibrations.

BRIEF DESCRIPTION OF THE DRAWINGS

The present invention will be now described, for illustrative but not limitative purposes, according to its preferred embodiments, with particular reference to the figures of the enclosed drawings, wherein:

FIG. 4 bis is a perspective view similar to FIG. 4 with the lamina connecting elements 2 and 3;

FIG. 5 is a bottom view of the skate of FIG. 1;

FIG. 9 is a perspective view of the elements of FIG. 8 coupled each other;

FIG. 9 bis is a perspective view of the two elements shown in FIG. 9 with the lamina connecting the elements shown in FIG. 8;

DETAILED DESCRIPTION OF THE PREFERRED EMBODIMENTS

A possible use of the invention for the embodiment providing four in-line wheels will be illustrated.

Figure 1:
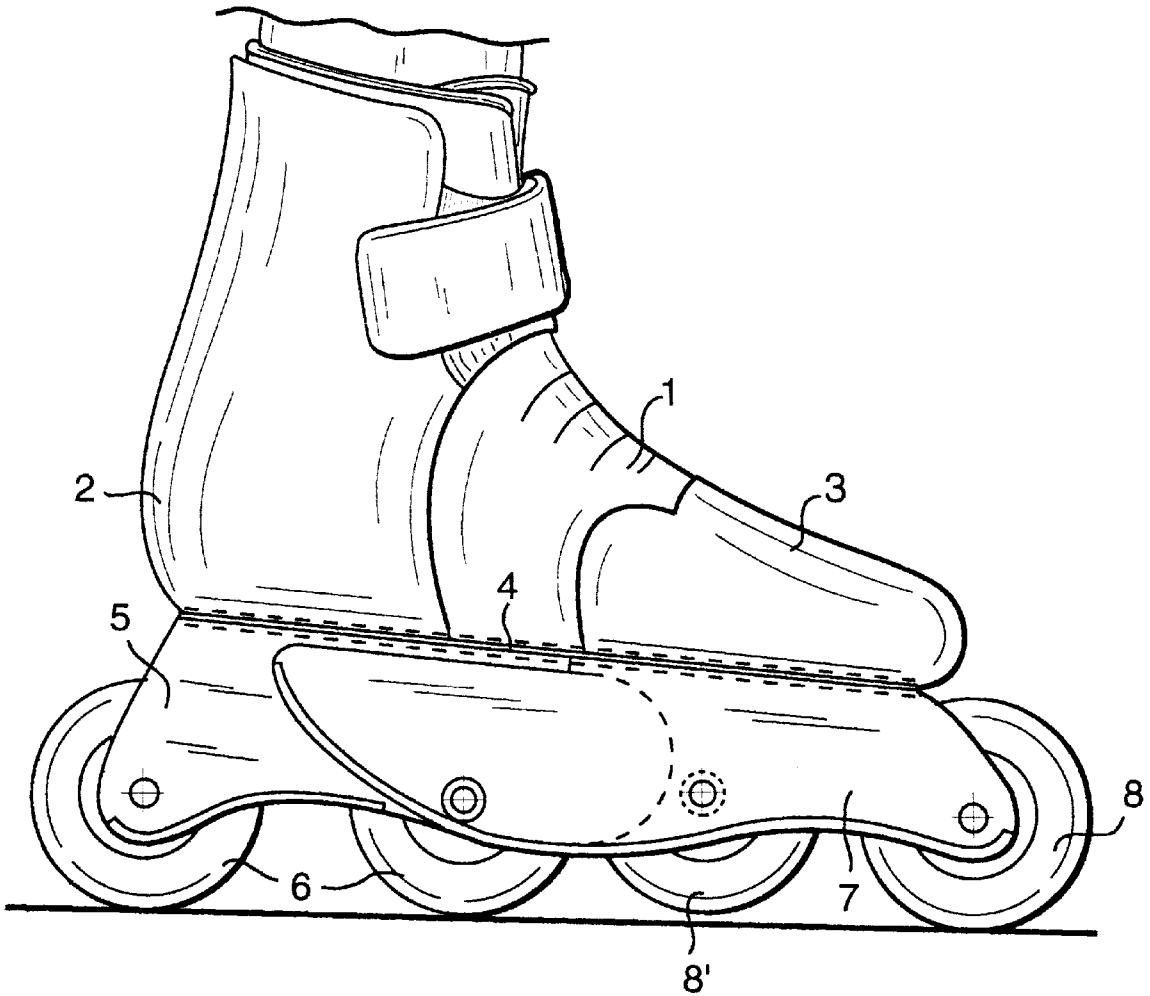
FIG. 1 is a lateral view of a skate according to the invention in the embodiment providing four in-line wheels.
Figure 2:
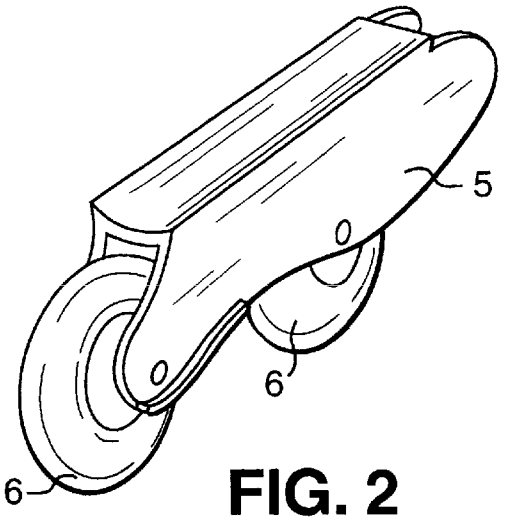

As it can be noted from FIG. 1, the skate according to the invention is comprised of an inner part 1, the half-boot, and of an outer part realized by a more rigid and resistant, made up of two separate bodies 2 and 3 which are fixedly coupled to each other by a steel flexible lamina 4 allowing the rotatory motion between the two bodies 2 and 3 and their automatic return back to the vertical plane. The rear body 2 is provided at the bottom with vertical elements 5 within which two in-line wheels 6 are housed as indicated in FIGS. 1 and 2, elements projecting forward of a certain amount to cinematically engage the front body 3.

Figure 3:
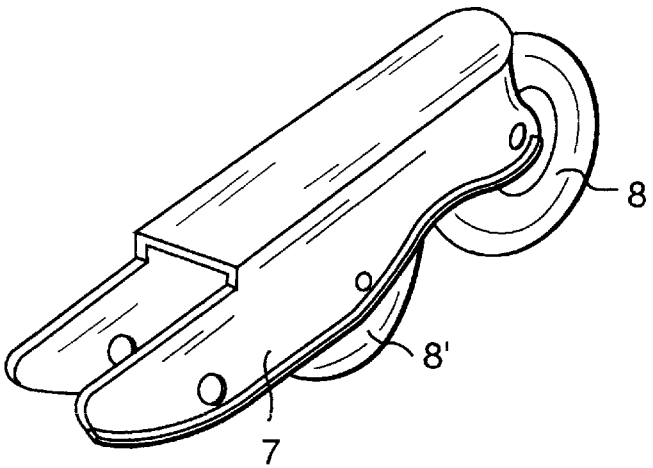
FIGS. 2 and 3 are a perspective view of the two front and rear elements, respectively, supporting the wheels.

Said tip front body is provided on the bottom with two vertical elements 7 within which two more in-line wheels 8' and 8 are housed. Said vertical elements 7 project backward to externally surrounding and engaging the vertical elements 5 of the rear body as indicated in FIGS. 1 and 3 and both the vertical elements 5 and the vertical elements 7 can be provided with intradorsal turn up, or they can have different stiffening shapes.

Figure 4:
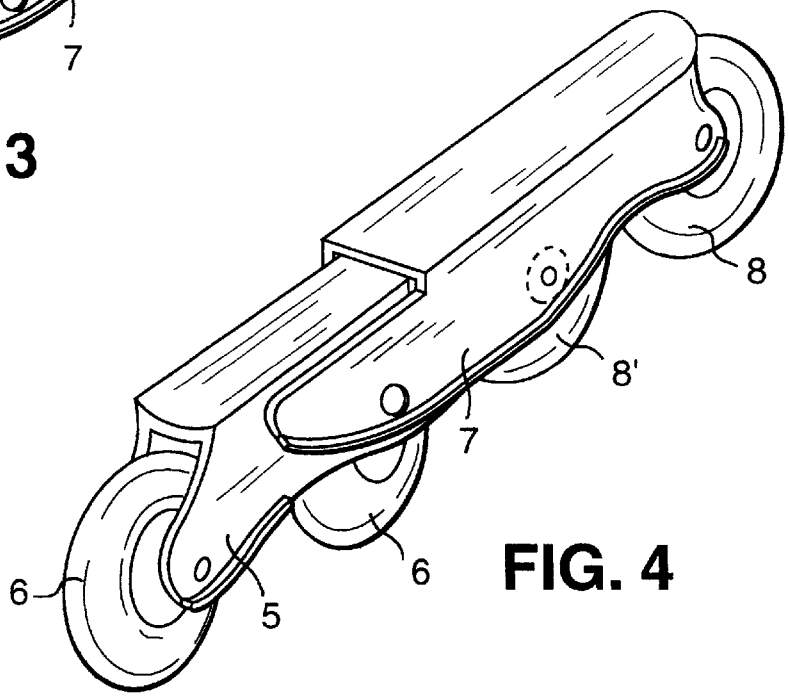
FIG. 4 is a perspective view of the elements of FIGS. 2 and 3 coupled each other.

As already said, the two rear and front bodies are then coupled each other by the steel flexible lamina 4, beside by the inner half-boot 1, as shown in FIG. 4 bis and as it can be seen from FIG. 1; combination and integralization of the inner half-boot 1, of the lamina 4, of the two rear 2 and front 3 bodies and of the vertical elements 7 and 5, can be realized in different ways, one of which is represented in FIG. 4 bis; the best mode of execution will depend on the executive technologies and on the materials used by those skilled in the art.

Figure 6:
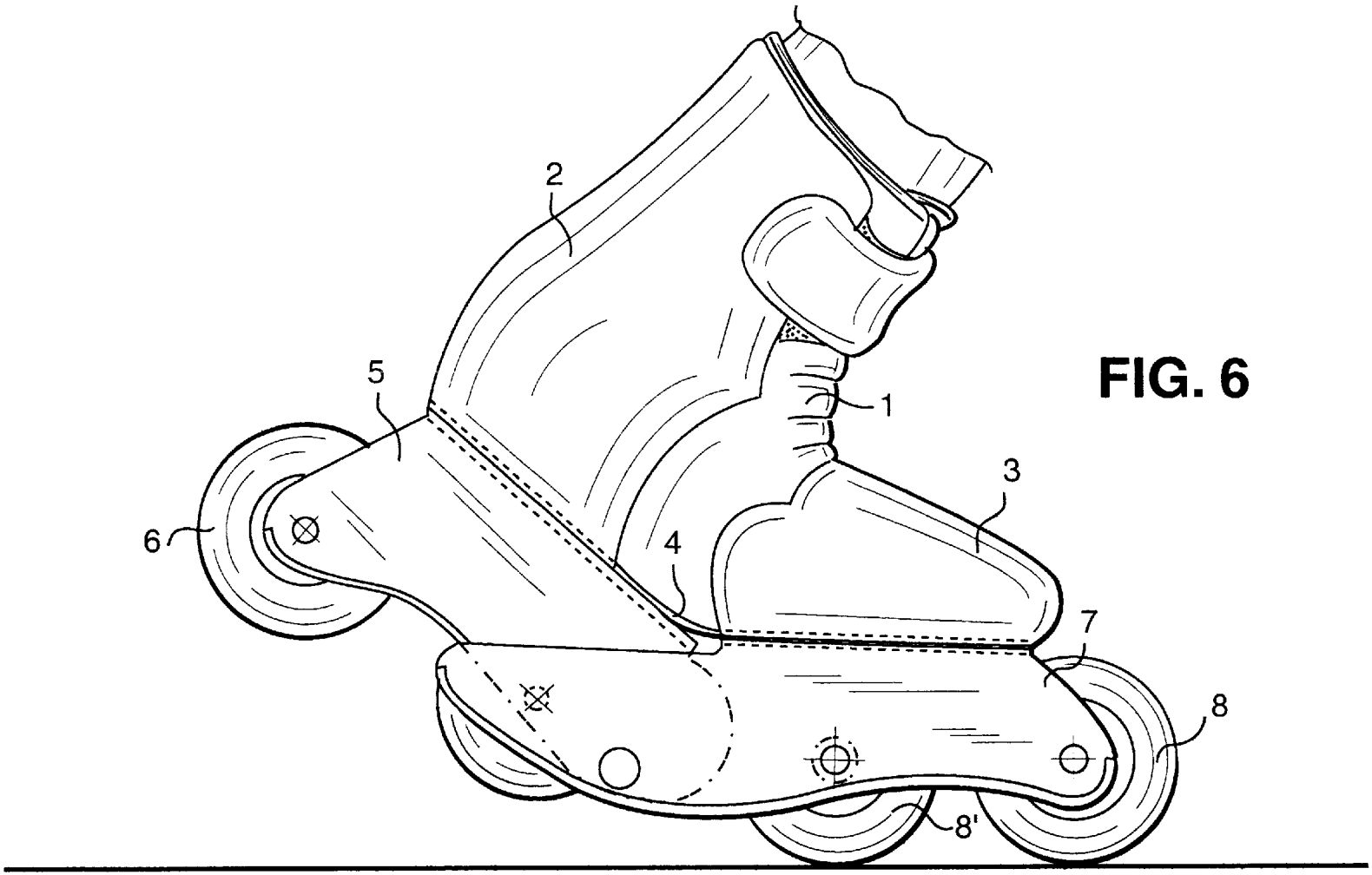
FIG. 6 is lateral view of the skate of FIG. 1 in a thrusting position.

In this way, inner half-boot, rear body and front body will constitute a sole unit which is also articulated, flexible and elastic, allowing to the foot to fold forward as indicated in FIG. 6 and to the skate to follow its movement articulating to assume again the original attitude as soon as the foot after the thrust lifts from the ground.

The part of the vertical elements of the rear body projecting forward and the part of the vertical elements of the front body projecting backward maintain, the first one sliding within the second one, their contact remaining cinematically coupled also when the foot is folded during the thrust on the two front wheels and the two rear wheels lift from the ground, as shown in FIG. 6.

In this way, it is ensured the necessary cinematic stiffness of the two bodies along a vertical plane during the relative rotative movement and thus the ankle is protected.

It is evident from FIGS. 1–3 that the wheel 8 of the front body 3 is placed slightly higher than the other wheels, so that when the skate is along a plane (not folded foot), only the other wheels are in touch with the ground, as indicated in FIG. 1.

In this position, even if it urges on three wheels, the skate is perfectly stable. In fact, notwithstanding a wheel is lifted from the ground, it cannot "warp" being prevented by the position of the wheels of the rear body, by the shape of the same and by the presence of the coupling lamina of the two bodies, as clearly shown in FIGS. 1–3.

When the foot folds during the thrust, thus lacking the rest of the two rear wheels 6, also when the wheel 8' is in touch with the ground and the front part of the foot urges on both the wheels of the front body 8, 8', as shown in FIG. 6.

The inner wheel 8' of the front body, beside being placed slightly higher than the other ones, has the feature of being able to rotate only according to one direction, namely forwardly, this effect being obtainable in different ways, the most simple being that of employing a so called "free" wheel, that can be obtained on the market. In this way, when the wheel 8' comes in contact with the ground, the skate cannot rotate backward and the thrust action can be exercised while the foot during the thrust phase does not need to be according to a diagonal direction to search for the grasping action, but it can remain forward oriented according to the motion direction.

FIG. 5 shows a bottom view of the skate according to the invention provided with four in-line wheels.

Figure 7:
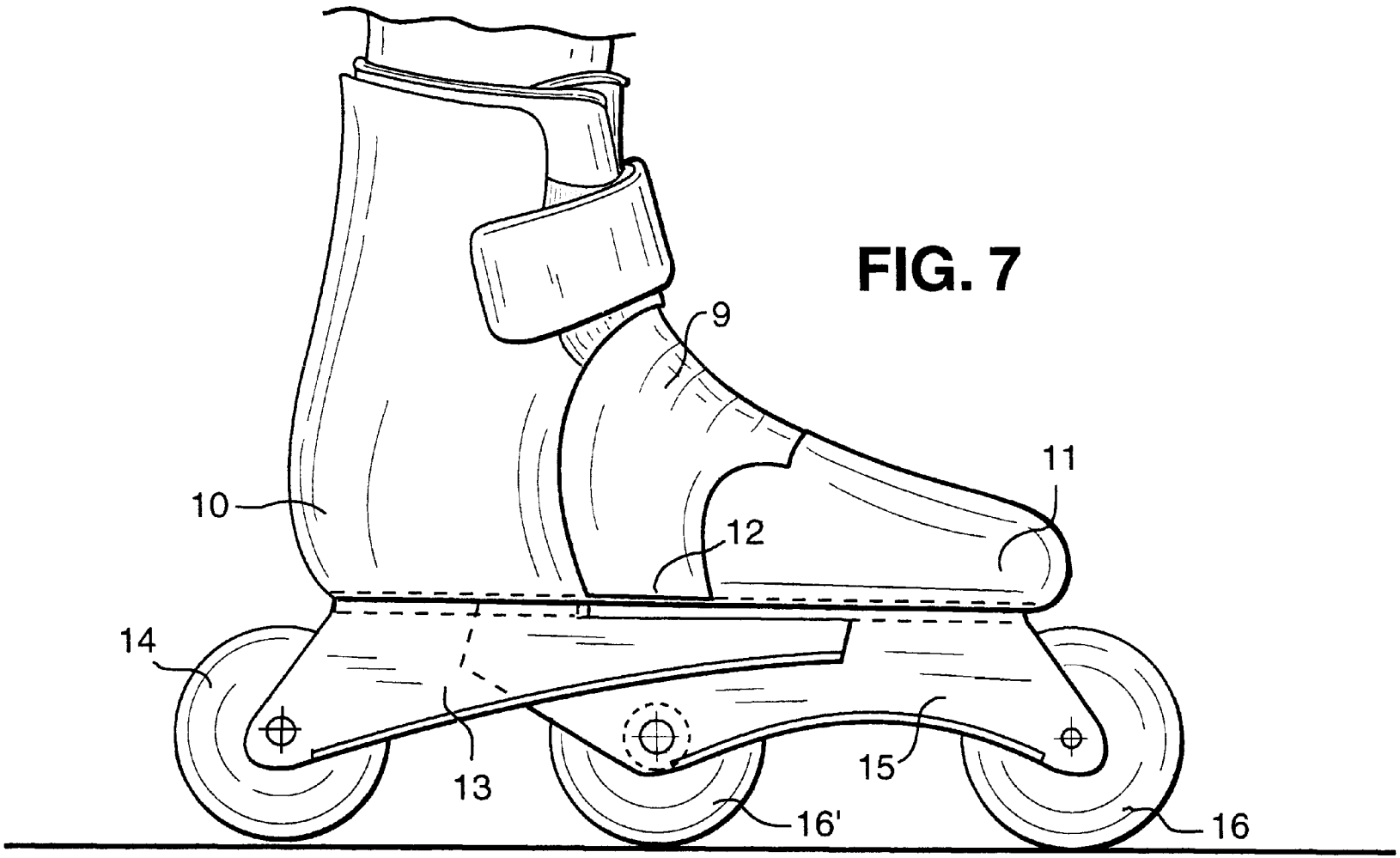
FIG. 7 is a lateral view of a second embodiment of the skate according to the invention provided with three in-line wheels.

A second embodiment of the present invention provides a three in-line wheel skate and is shown in FIG. 7.

Figure 8:
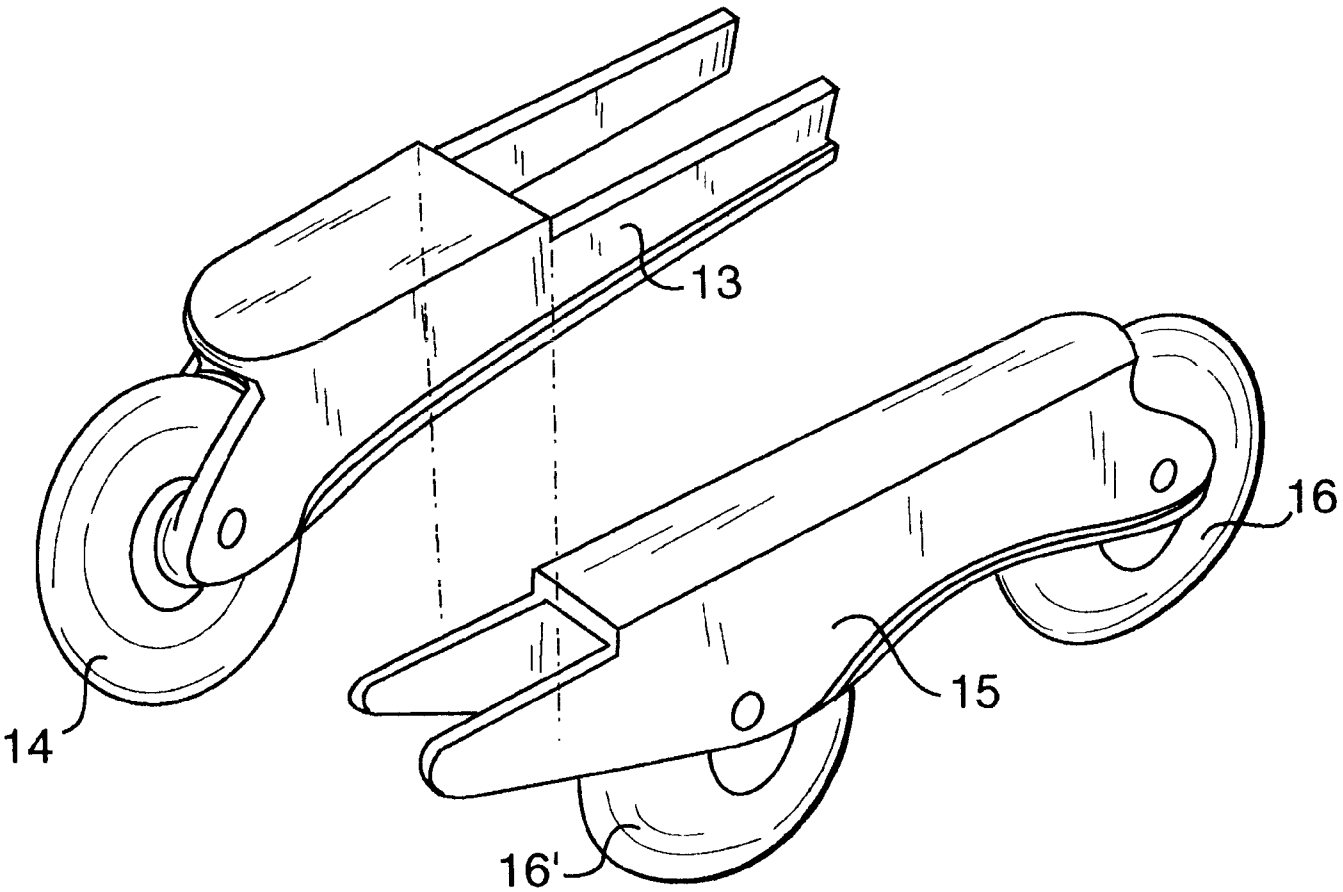
FIG. 8 is a perspective view of the front and rear elements, respectively, supporting the wheels in a disassembled state.

The skate, schematically shown in FIG. 7, is comprised of an inner half-boot 9, of the rear body 10, of the front body 11, fixedly coupled by the steel flexible lamina 12 or by other means able to perform the same function. At the bottom, body 10 has the vertical elements 13, within which the wheel 14 is housed, as indicated in FIGS. 7 and 8, elements projecting forward to cinematically engage the front body 11 and can be provided with intradorsal stiffening turn up or they can have stiffening shapes thanks to outer ribs or cambers. The front body 11 is provided at the bottom with vertical elements 15, as indicated in FIG. 7, within which two in line wheels 16 and 16' are housed. Said elements 15 project backward to insert, cinematically engaging with the same, in the elements 13 of the rear body, as shown in FIGS. 7 and 9, and can be provided, as well as the elements 13, with intradorsal turn up, or they can have different stiffening shape.

Figure 10:
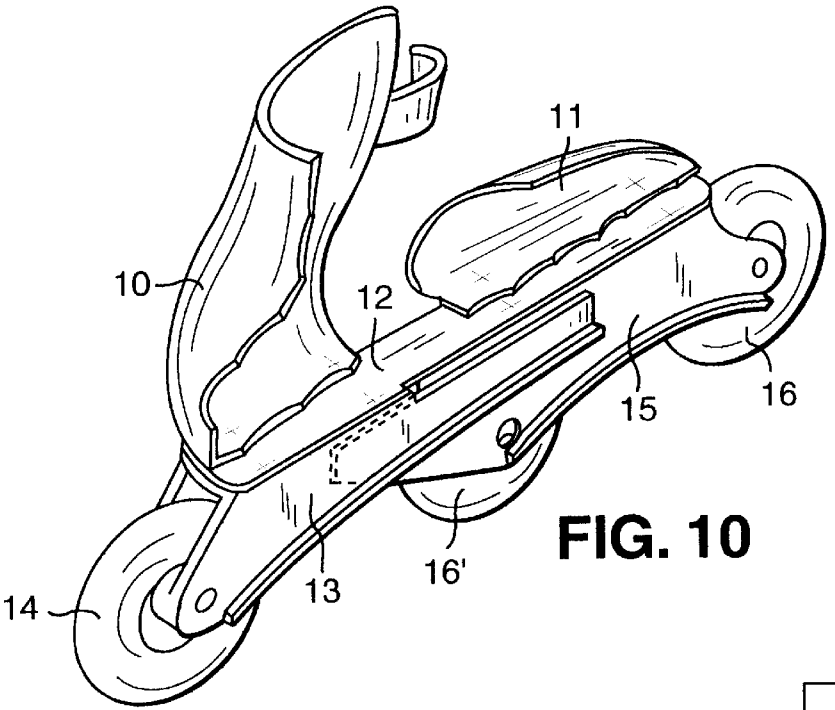
FIG. 10 is a perspective view of the two elements shown in FIGS. 8 and 9 coupled each other and provided with the elastic element and of the outer half-boot portion.
Figure 11:
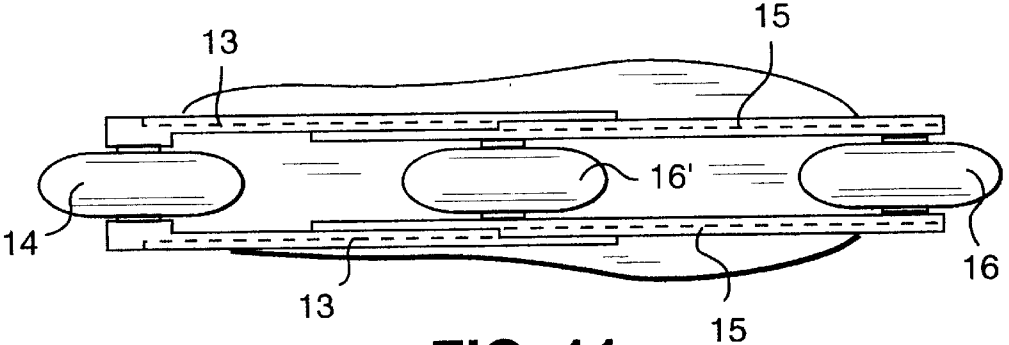
FIG. 11 shows a bottom view of the skate of FIG. 7.

As already said, the two rear 10 and front 11 bodies are then coupled each other, by the half-boot 9, and by the steel lamina 12, as indicated in FIG. 9 bis and FIG. 10.

Figure 12:
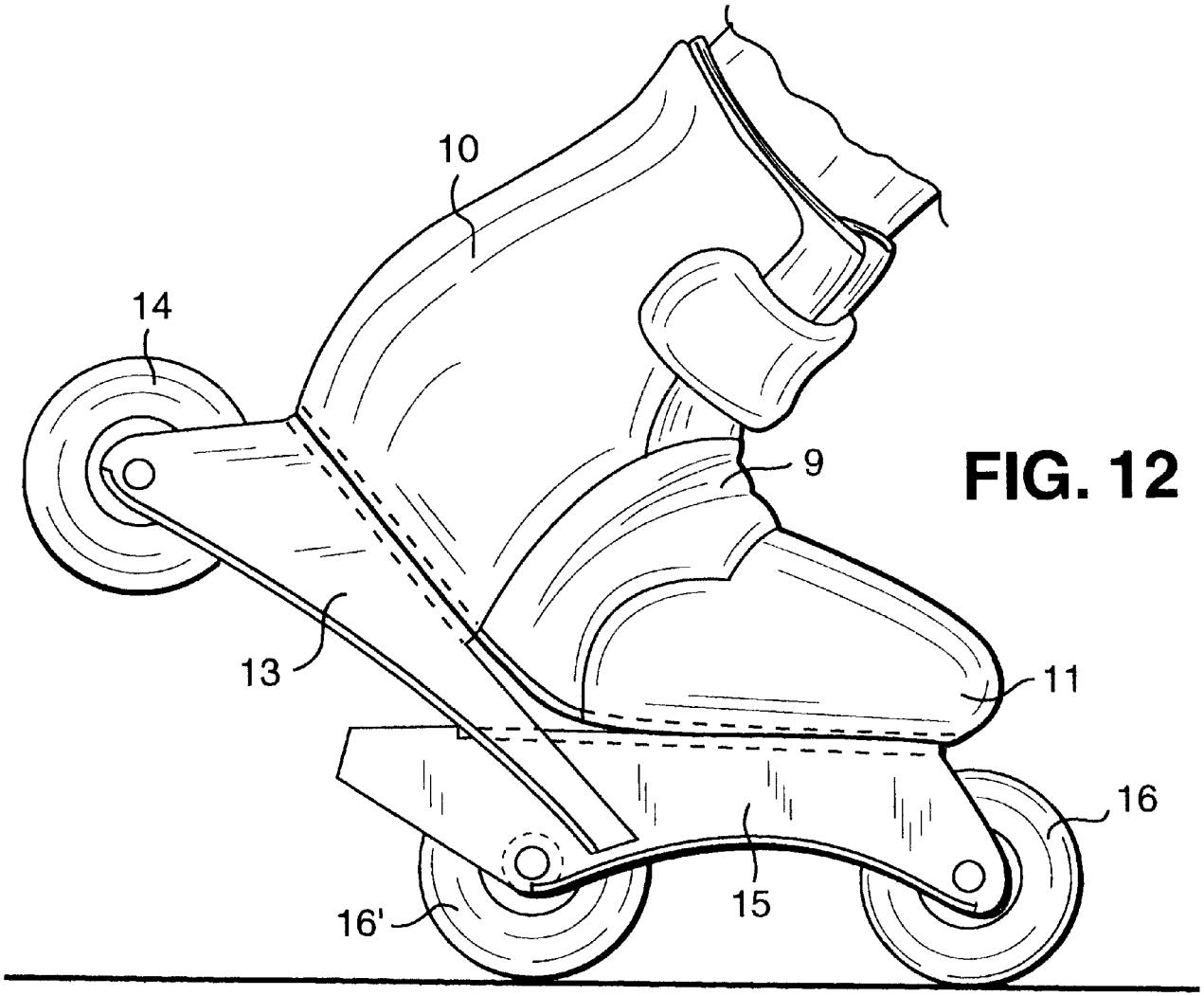
FIG. 12 shows a lateral view of the skate of FIG. 7 in the thrusting position.

In this way, half-boot, rear body and front body will constitute a sole unit which is also articulated, flexible and elastic, allowing to the foot to fold forward as indicated in FIG. 12 and to the skate to follow its movement articulating to assume again the original attitude as soon as the foot after the thrust lifts from the ground.

It can be noted that the central wheel 16' has the feature already described with respect to the embodiment of the four wheel skate, to be able to rotate only according to one direction, namely forward, e.g. employing the so called "free wheel" solution. In this way, when the foot folds during the thrust phase, the skate cannot rotate backward and the thrust action can be exercised without the need to put the foot along a diagonal direction, but it can remain forward oriented along the motion direction.

Differently with respect to the previous embodiment, the three in-line wheel skate shown in FIG. 7–12 has the feature to prevent the rotation movement backward not only when the foot is folded, but also when the foot urges on a plane on all the wheel, taking into consideration the position of the wheel indicated by the reference number 16', said wheel remaining in contact with the ground.

Figure 13:
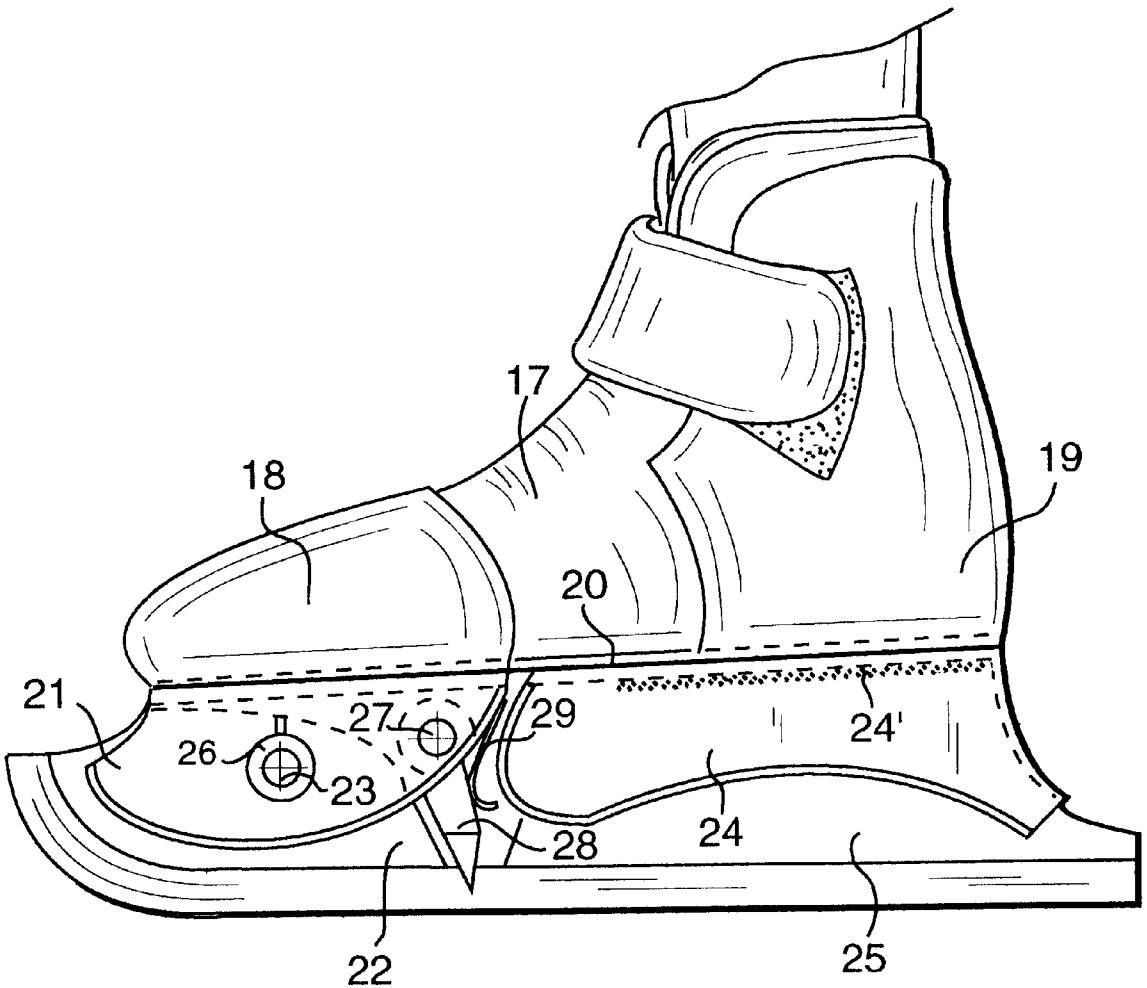
FIG. 13 is a lateral view of a third embodiment of the skate according to the invention provided with a blade to skate on the ice in a sliding position.
Figure 14:
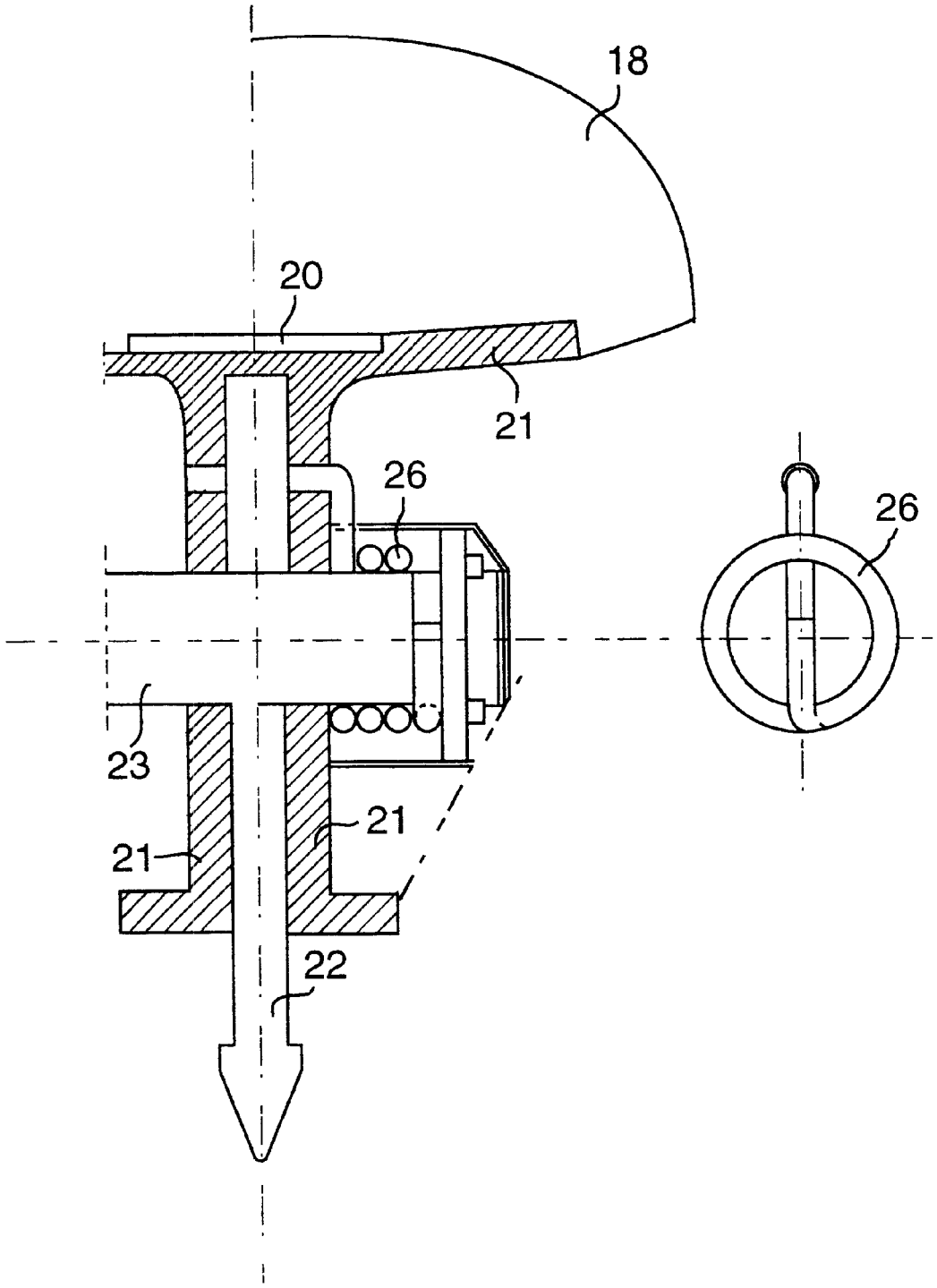
FIG. 14 is a sectional view of the skate of FIG. 13 on the pin element provided in a front position.
Figure 15:
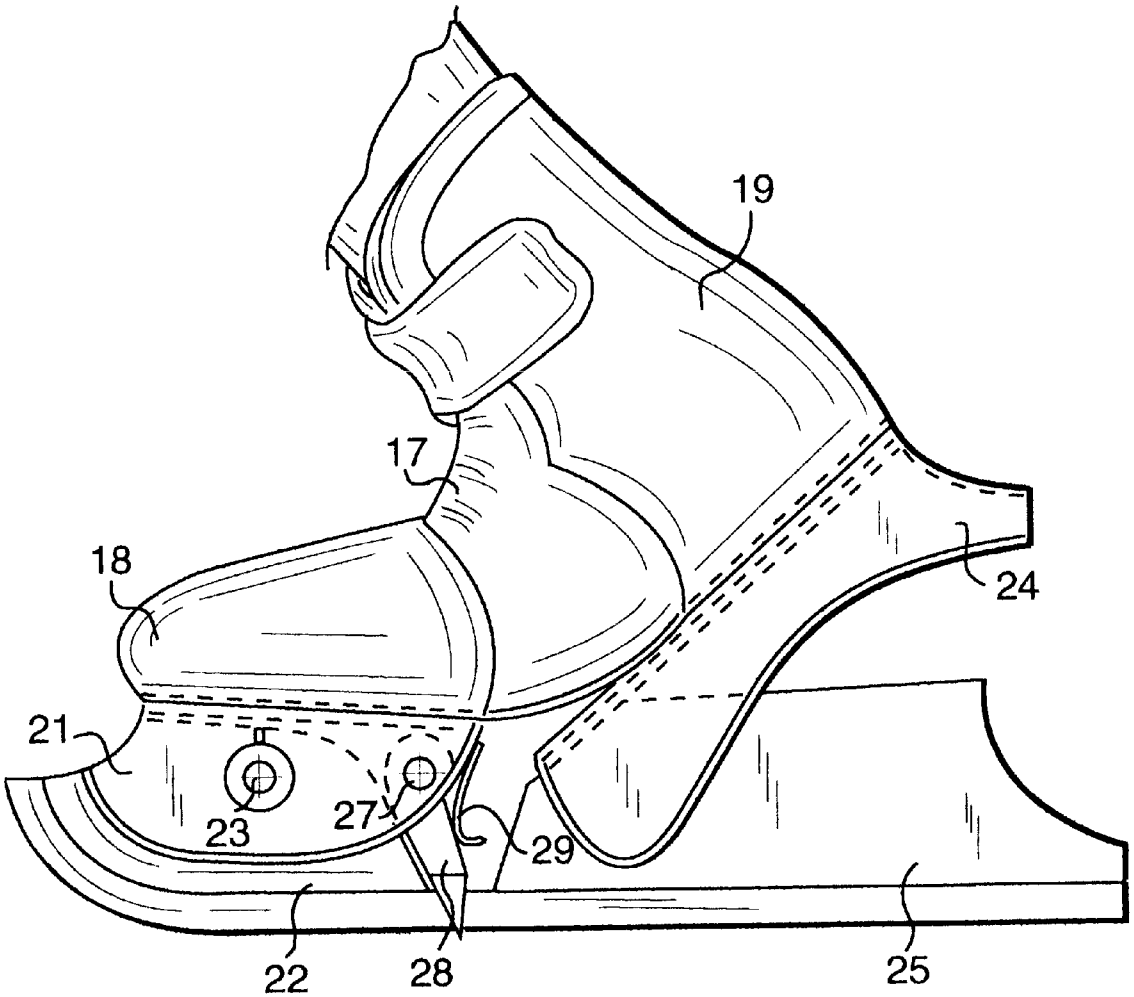
FIG. 15 is a lateral view of the ice skate in a thrusting position.

A further embodiment of the present invention concerns a skate that can be used on the ice and is shown in FIGS. 13–15: in this case too the same innovative criteria already set forth for the in-line wheel skate are valid, on the basis of which the skate gives the opportunity of actuating also on the ice beside for the traditional skating, the new way of skating, avoiding the need of placing the skate diagonally to obtain the necessary thrust. This possibility is obtained allowing to the foot during the thrust phase, to fold remaining oriented according to the same motion direction and allowing to the skate to grasp the ice without sliding backward.

As it can be noted from FIG. 13, the skate is comprised of an half-boot inner part 17 and of an outer part, made up of rigid material, and divided in two different bodies 18 and 19, coupled each other by a steel horizontal flexible lamina 20 or by any other means suitable to perform the same functions.

The front body 18 is provided at the bottom with vertical elements 21 within which the front part 22 of the sliding blade is housed and that remains coupled with these elements by a pin 23, which is fixedly coupled with the same blade. Also the rear body 19 is provided at the bottom with vertical elements 24, within which the rear portion 25 of the blade is housed; a front body 21 is also provided, in correspondence with the pin 23 coupling and connecting the same with the blade, with a pair of coil springs 26 co-acting with and provided around the pin 23, in correspondence of its ends, as shown in FIG. 14. Said springs has the function of maintaining the blade in contact with the rear body also when the skate is lifted from the ground.

When the foot is flat, i.e. it completely rests on the skate, the front body 18 bears on the pin 23 coupling with the blade 22, and the rear body 19 bears on the part 25 of the same blade, suitably shaped as indicated in FIG. 13. Between vertical elements 24 and the rear part 25 of the blade a rubber strip 24 bis, or made up another suitable material, is provided to reduce the noise due to the contact.

It can be also noted that on the vertical elements 21 of the front body 18 a second pin 27 is housed, serving to support a steel tooth 28, bridged between the blade to end some millimeters higher than the edge of said blade, so that, when the skate advance parallel with respect to the ground, the tooth 28 will be not in contact with the ice; instead, when the foot folds during the thrusting phase, as shown in FIG. 15, and the rear body 19 lifts, the front body 18 rotates backward about the coupling pin 23 until the tooth 28 does meet the ice surface.

Now, the skate "locks" the ice and cannot slide backward so that the skater can give the thrust necessary to the advancement.

As it can be noted from FIGS. 13, 15, the tooth 28 cannot rotate according to a clockwise direction since it is prevented by the vertical elements 21 of the front body 16 against which abuts, while it can rotate in an anticlockwise direction, even if slightly bucked by a steel tongue 29, having the sole function of maintaining it in the position without vibrating. The tooth, with the above cinematic, can never brake the skate scraping the ice while the skate slides forward; it cannot also scraping the ice going backward with the foot in a flat position. It can incise the ice only when the foot is folded during the thrust, since, also with the folded foot, if the thrust is not given, the tooth, due to the anticlockwise rotation freedom, even if it touches the iced surface, slides on the same. It must also be said that the tooth is realized in such a way to not be able to incise the ice more than necessary and programmed, since, beyond a certain flexion movement its inner part meets the blade, blocking the same.

Finally, it must be said that when the foot is folded and the heel is lifted as indicated in FIG. 15, the rear body of the skate is cinematically coupled with the blade, suitably shaped by its vertical elements and then the necessary stiffness remains to the assembly comprised of the two rear and front bodies, to protect the ankle.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A skate, comprising:

an outer rigid portion having a first front portion and a second rear portion;

an inner footwear portion disposed within said first front portion and said second rear portion;

a flexible element coupling said first front portion and said second rear portion to each other, said flexible element being disposed underlying at least a portion of said first front portion and said second rear portion, being flexible to permit relative rotational movement from an alignment position of sad fire front portion and said second rear portion, and being resilient to permit automatic return of the first front portion and second rear portion to said alignment position;

a pair of substantially separate vertical elements with one of said vertical elements carried by said first front portion and The other of said vertical elements carried by said second rear portion with at least a portion of one of said pair of vertical elements disposed within at least a portion of the other of said vertical elements;

four wheels disposed in-line with each of said pair of vertical elements rotatably carrying at least one of said wheels and with each of said wheels being rotatable in at least one direction permitting advancement of the skate, wherein at least one wheel is an inner wheel carried by the vertical element of the first front portion and said inner wheel is disposed higher than the other wheels when the first front portion and second rear portion are in said alignment position; and a locking system operably associated with said inner wheel to prevent rotation of said inner wheel in a direction opposing advancement of the skate.

2. A skate according to claim 1 characterized in that said vertical elements carried by said front and rear portions are provided with ribs for stability and rigidity.

3. A skate according to claim 1 wherein said inner most wheel is of the free wheel type comprising said locking system to prevent rotation in one direction of said innermost wheel.

4. A skate according to claim 1 wherein each of the vertical element carried by the first front portion and the vertical element carried by the second rear portion comprises a pair of spaced apart parallel plates with the wheels disposed between the plates.

5. A skate according the claim 4 wherein at least a portion of the plates of the vertical element carried by the second rear portion are disposed between at least a portion of the plates of the vertical element carried by the first front portion.

6. A skate, comprising:

an outer rigid portion having a first front portion, and a second rear portion providing relative rotational movement to and from an alignment position of said first front portion and said second rear portion;

an inner footwear portion disposed within said first front portion and said second rear portion;

a pair of substantially separate vertical elements with one of said vertical elements carried by said first front portion and the other of said vertical elements carried by said second rear portion with at least a portion of one of said pair of vertical elements disposed within at least a portion of the other of said vertical elements;

a plurality of wheels with each of said pair of vertical elements rotatably carrying at least one of said wheels, wherein at least one wheel is an inner wheel carried by the vertical element of the first front portion and said inner wheel is disposed higher than the other wheels when said first front portion and second rear portion are in said alignment position; and a locking system operably associated with said inner wheel to prevent rotation of said inner wheel in a direction opposing advancement of the skate.

7. The skate of claim 6 wherein the inner wheel with the locking system is raised relative to the other wheels when the outer rigid portion is in its alignment position.

* * * * *